US007708458B2

(12) United States Patent
Karapatis

(10) Patent No.: US 7,708,458 B2
(45) Date of Patent: May 4, 2010

(54) WATCH WITH A STRIKING WORK

(75) Inventor: Nakis Karapatis, Premier (CH)

(73) Assignee: Montres Breguet S.A., L'Abbaye (CH)

( * ) Notice: Subject to any disclaimer, the term of this patent is extended or adjusted under 35 U.S.C. 154(b) by 0 days.

(21) Appl. No.: 11/860,979

(22) Filed: Sep. 25, 2007

(65) Prior Publication Data

US 2008/0074956 A1 Mar. 27, 2008

(30) Foreign Application Priority Data

Sep. 26, 2006 (EP) ..... 06121237

(51) Int. Cl.
*G10K 1/06* (2006.01)
*G10K 1/08* (2006.01)

(52) U.S. Cl. ..... 368/315; 368/244; 116/152; 116/162

(58) Field of Classification Search ..... 368/276, 368/72, 243, 269–271, 315
See application file for complete search history.

(56) References Cited

U.S. PATENT DOCUMENTS 2,742,875 A * 4/1956 Junghans et al. ..... 116/169
2,948,105 A * 8/1960 Levy ..... 368/244
D485,501 S * 1/2004 Wright et al. ..... D10/40

FOREIGN PATENT DOCUMENTS

| | | | |
|---|---|---|---|
| CH | 45807 | | 11/1908 |
| CH | 0451340 | * | 11/1991 |
| DE | 3917636 C1 | | 9/1990 |
| EP | 0 400 205 A1 | | 12/1990 |

OTHER PUBLICATIONS

European Search Report issued in corresponding application No. EP 06 12 1237, completed May 30, 2007.
"Grade 3 Science—Optional Unit: Sound," printed from http://www.sasked.gov.sk.ca/docs/elemsci/gr3uiesc.html on Apr. 8, 2009.
Berner, G.-A., excerpt from "Disctionnaire Professionnel Illustré de l'Horlogerie I + II," 2002, pp. 1091-1092.

* cited by examiner

*Primary Examiner*—Vit W Miska
*Assistant Examiner*—Sean Kayes
(74) *Attorney, Agent, or Firm*—Griffin & Szipl, P.C.

(57) ABSTRACT

The invention concerns a watch with a striking work including a bottom plate and a gong including two ends, the gong being secured via a first end to the bottom plate. According to the invention, the second end of the gong is also secured to said bottom plate.

17 Claims, 2 Drawing Sheets

WATCH WITH A STRIKING WORK

This application claims priority from European Patent Application No. 06121237.9, filed Sep. 26, 2006, the entire disclosure of which is incorporated herein by reference.

FIELD OF THE INVENTION

The present invention relates to the field of watchmaking. It concerns more specifically a watch with a striking work, such as a repeater watch or an alarm watch.

BACKGROUND OF THE INVENTION

Such watches are fitted with an element that vibrates via the action of a hammer, and thus produces, directly or indirectly, an acoustic wave, via another part. The vibrating element may be a bell, a gong or an element of the type disclosed in EP Patent No. 0 400 205. The bell is voluminous and solid. The same is true of the element disclosed in EP Patent No. 0400 205, formed of a solid rigid crown, mounted on a flexible securing element including two arms, the ends of which are secured to a support. The gong, which is small and compact, is generally preferred. The gong is generally formed of a metal strand of circular cross-section, or of a metal strip, forming a winding whose length is variable depending upon the desired tonality. Secured to the bottom plate via one of its ends, the gong transmits vibrations to the bottom plate, which itself can emit an acoustic wave. Consequently, the quality of coupling between the gong and the bottom plate plays an important role as regards the acoustic power transmitted and the sound quality.

In the case of gongs of large length, such as the gongs fitted to pocket watches, or "cathedral" type gongs, which correspond to two turns around the bottom plate, the gong vibration amplitude can be significant. It sometimes happens that the gong enters into contact with the bottom plate, the middle part or the hammers, which denatures the sound produced. This contact can also occur via the effect of a shock and, in such case, the gong vibrates unexpectedly, thus being able to generate an unexpected and disagreeable sound.

The present invention overcomes these drawbacks by proposing a watch with a striking work fitted with a gong whose vibration amplitude is limited so as to prevent any contact between the gong and a neighbouring part, and thus coupling with the bottom plate is improved.

SUMMARY OF THE INVENTION

More specifically, the invention concerns a watch with a striking work including a support element and a gong forming a winding including two ends, said gong being secured via a first end to the support element. According to the invention, the second end of the gong is also secured to the support element.

In an advantageous embodiment, the bottom plate forms the support element.

Owing to the fact that both ends of the gong are secured to the bottom plate, the vibration amplitude is reduced and the transmission of vibratory energy is increased. Against all expectations, and contrary to a widespread prejudice according to which one of the ends of the gong has to be free, the acoustic quality and power are thus improved.

BRIEF DESCRIPTION OF THE DRAWINGS

Other features and advantages of the present invention will appear more clearly from the following detailed description of an example embodiment of a watch with a striking work according to the invention, this example being given purely by way of illustrative and non-limiting example, in conjunction with the annexed drawing, in which.

DETAILED DESCRIPTION OF THE ILLUSTRATIVE EMBODIMENTS

Figure 1:
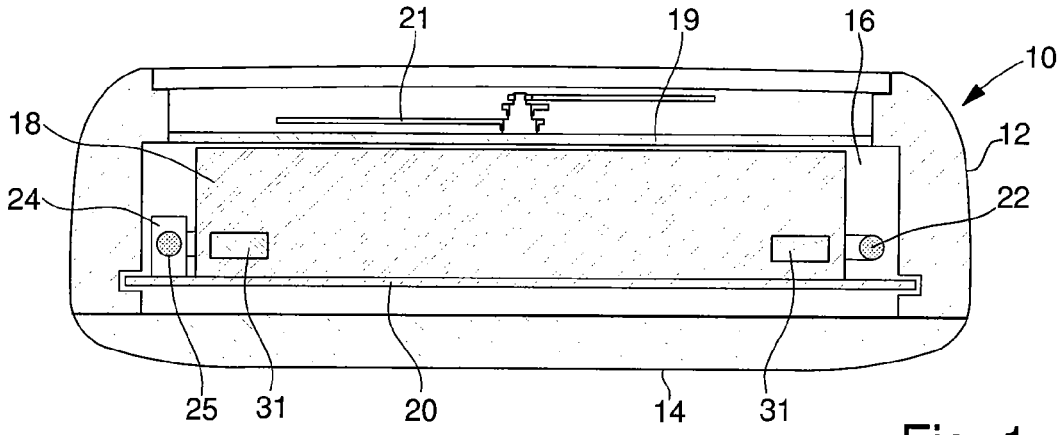
FIG. 1 is a schematic cross-section of a watch with a striking work according to the invention.

The watch with a striking work shown schematically in FIG. 1 includes, in a conventional manner, a case 10 formed of a middle part 12 and a back cover 14, together defining a housing 16. A movement 18 mounted on a bottom plate 20 is arranged inside housing 16. A dial 19 is mounted on said movement, which drives a set of hands 21 in rotation. A gong 22, forming a winding around movement 18, is fixedly mounted on bottom plate 20, via a first gong carrier 24 secured to bottom plate 20. Gong 22 has a circular cross-section, but in a variant, it could have a rectangular cross-section. It is generally made of steel.

Gong carrier 24 is formed of a block screwed to bottom plate 20 and pierced with a hole 25 in which a first end of gong 22 is engaged and brazed. This securing method is well known to those skilled in the art. As an alternative, said first end of gong 22 could be welded to gong carrier 24, or screwed between two counterparts. In another variant, gong 22 and the first gong carrier 24 form a single part secured to bottom plate 20. In practice, those skilled in the art will chose the appropriate securing method in order to optimise the coupling between gong 22 and bottom plate 20, so as to transmit a maximum vibration from gong 22 to bottom plate 20.

Figure 2:
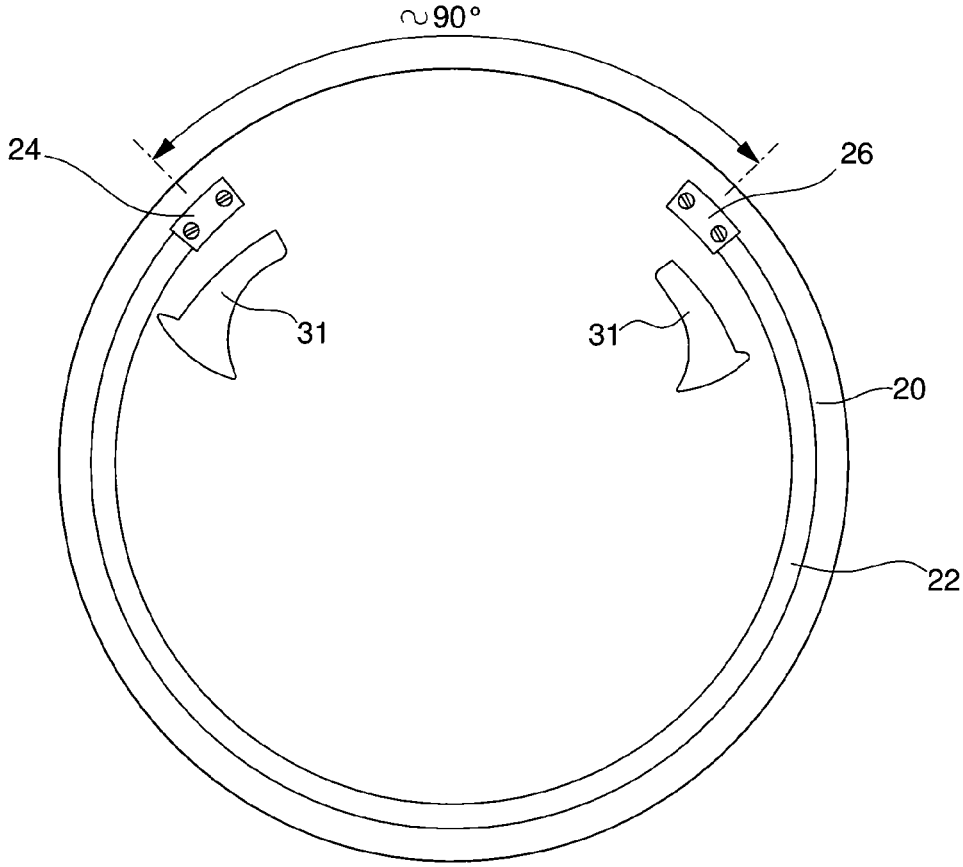
FIG. 2 is a top view of a bottom plate of the watch with a striking work shown in FIG. 1, and FIGS. 3 and 4 are variants of the embodiment illustrated in FIG. 2.

Hammers 31, shown in FIG. 1 and in FIG. 2, are disposed to strike gong 22 in a substantially parallel plane to the general plane of the watch. These hammers 31 are controlled by a striking mechanism, such as a repeater mechanism, mounted on bottom plate 20, but the repeater mechanism is not shown in FIG. 1.

A top view of bottom plate 20 of the watch with a striking work according to the invention is shown in FIG. 2, without movement 18. The gong 22 forms a winding extending in a conventional manner over an angular sector of approximately 270 degrees. As mentioned previously, it is secured by a first end to bottom plate 20, via first gong carrier 24.

According to the invention, gong 22 is also secured to bottom plate 20 by its second end. Thus, a second gong carrier 26 is mounted integral to bottom plate 20. The second end of gong 22 is secured to this second gong carrier 26 by a securing method of the same nature as that of the first end. In a variant, the second end could be secured differently. In another embodiment, gong 22, first gong carrier 24 and second gong carrier 26 form a single part secured to bottom plate 20. Whichever method is used to secure gong 22 to gong carriers 24, 26, account will be taken of the fact that a phase opposition may occur between the waves respectively reaching the first and second gong carriers 24 and 26. This phase opposition may lead to the extinction of one or several vibration frequencies, as a function of the length traveled from the point of impact of the hammers to gong carriers, 24, 26, and the speed of propagation of the wave. The length of gong 22 must thus be chosen while taking this element into consideration.

Figure 3:
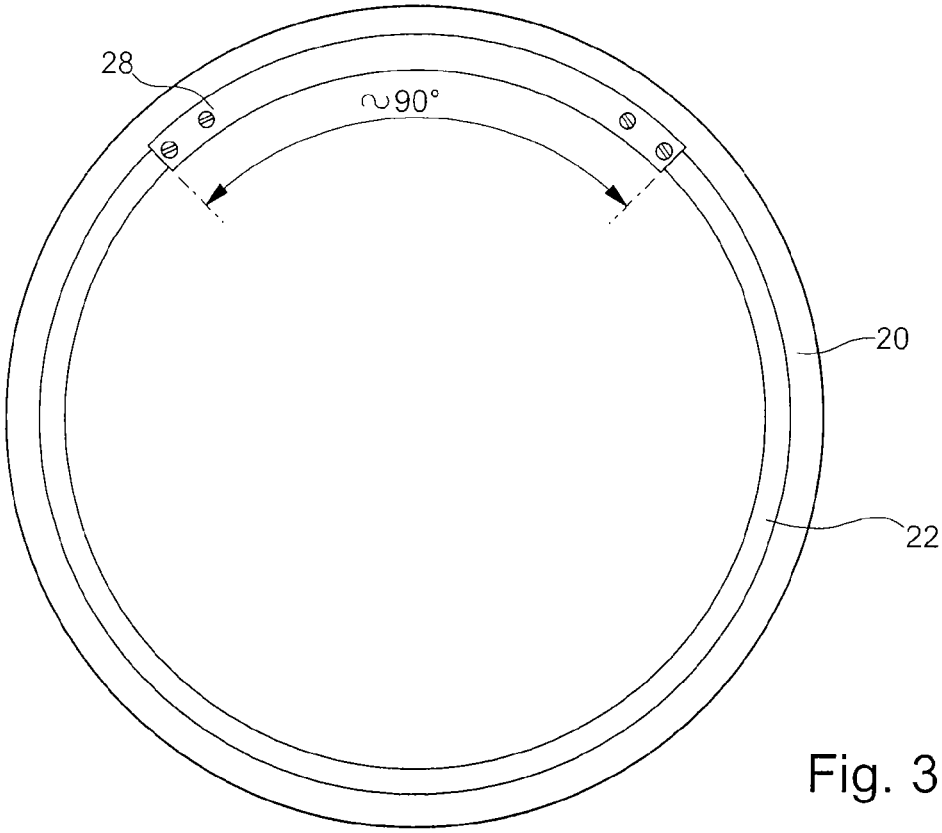

According to a variant of the preceding arrangement, illustrated in FIG. 3, gong 22 is secured via both of its ends to a single gong carrier 28 extending over the angular sector comprised between the first and second end of gong 22.

Figure 4:
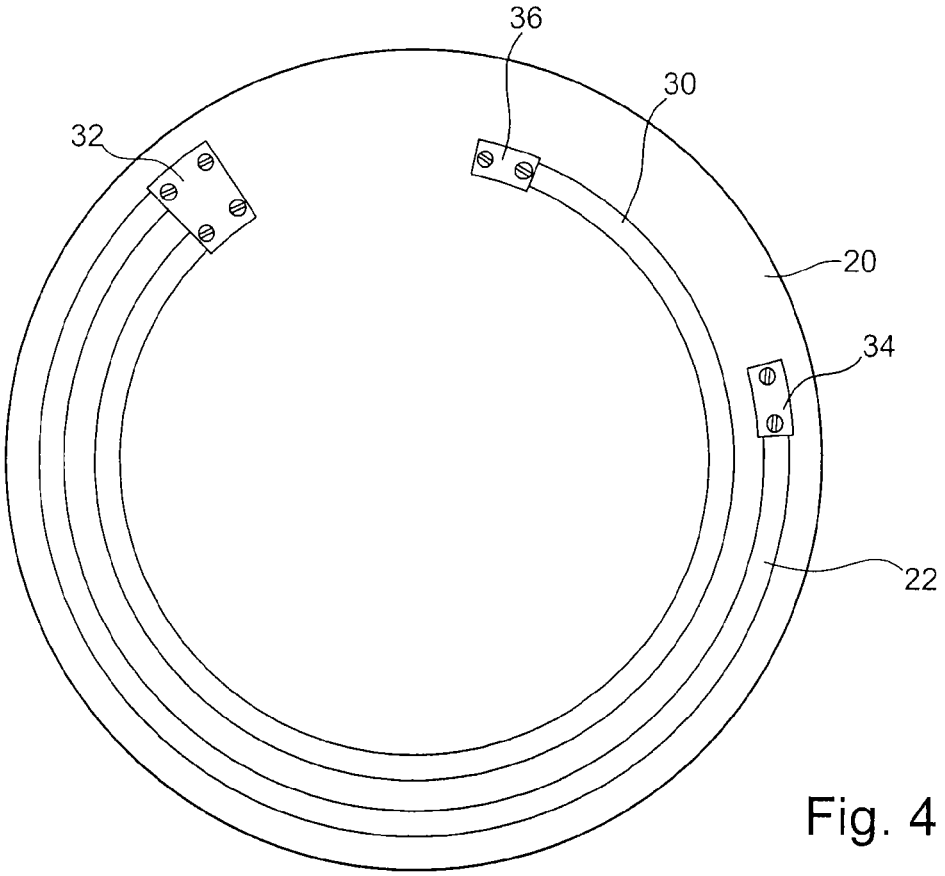

Finally, FIG. 4 shows a bottom plate 20 of a watch with a striking work according to the invention, including two gongs wire respectively 22, 30, of different lengths, for producing two different tonalities. The first two ends are conventionally secured to a common gong carrier 32 mounted on bottom plate 20. The other two ends are secured to two gong carriers 34, 36 mounted integral with bottom plate 20. As previously, wire gongs 22, 30 are secured to gong carriers 32, 34, 36 by brazing, or any other securing method.

Of course, the watch with a striking work according to the invention is not limited to the embodiment that has just been described and various simple alterations and variants could be envisaged by those skilled in the art without departing from the scope of the invention as defined by the annexed claims.

It will be noted, in particular, that gong 22 could be fixed to a different support element from bottom plate 20, for example case 10. In this type of embodiment, both ends of gong 22 are secured to case 10, using one or two gong carriers 24, 26, 28. In a variant, gong 22 is secured by one end to bottom plate 20 and by the other end to case 10.

What is claimed is:

1. A watch provided with a striking work including:

a support element;

a gong forming a winding including two ends, wherein said gong is secured via a first end to said support element, and wherein a second end of the gong is also secured to said support element; and hammers disposed to strike the winding of the gong so the gong vibrates and generates sound.

2. The watch provided with a striking work according to claim 1, wherein said support element is formed by a bottom plate.

3. The watch provided with a striking work according to claim 1, further including a first gong carrier mounted on said support element, and wherein at least said first end of the gong is secured to said first gong carrier.

4. The watch provided with a striking work according to claim 3, wherein said second end of the gong is secured to said first gong carrier.

5. The watch provided with a striking work according to claim 3, further including a second gong carrier mounted on said support element, and wherein said second end of the gong is secured to said second gong carrier.

6. The watch provided with as striking work according to claim 5, wherein one of said two ends is secured to one of said first gong carrier and said second gong carrier, by brazing or welding.

7. The watch provided with a striking work according to claim 5, wherein one of said two ends is secured to one of said first gong carrier and said second gong carrier by screws.

8. The watch provided with a striking work according to claim 3, wherein said first gong carrier forms a single piece with said gong.

9. The watch provided with a striking work according to claim 1, wherein said gong is a wire-shaped gong.

10. The watch provided with a striking work according to claim 1, wherein said watch comprises a watch movement and wherein said gong extends around the watch movement.

11. The watch provided with a striking work according to claim 10, wherein said gong extends over approximately 270° around said watch movement.

12. A watch with a striking work including a support element and a gong consisting of a winding having first and second ends, the first and second ends both being secured to the support element.

13. A watch provided with a striking work including:

a support element;

a gong forming a winding including two ends, wherein the gong is secured via a first end to said support element, and wherein a second end of the gong is also secured to said support element; and a gong carrier mounted on said support element, wherein the first end of the gong is secured to said gong carrier and the second end of the gong is secured to said gong carrier, and wherein said gong carrier extends from the first end to the second end of the gong.

14. A watch provided with a striking work including:

a support element;

a first gong forming a winding including two ends, wherein the first gong is secured via a first end to said support element, and wherein a second end of the first gong is also secured to said support element;

a first gong carrier mounted on said support element, wherein the first end of the first gong is secured to said first gong carrier; and a second gong carrier mounted on said support element, wherein the second end of the first gong is secured to said second gong carrier, and wherein said first gong carrier forms a single piece with the first gong and said second gong carrier.

15. The watch provided with a striking work according to claim 14, wherein a second gong is secured via both ends thereof to said support element.

16. The watch provided with a striking work according to claim 14, wherein the length of said gong is selected so as to take account of phase opposition phenomena.

17. A watch provided with a striking work including:

a support element; and a first gong forming a winding including two ends, wherein said first gong is secured via a first end to said support element, and wherein a second end of said first gong is also secured to said support element; and a second gong secured to said support element.

* * * * *